US012796730B2

(12) United States Patent
Choi

(10) Patent No.: US 12,796,730 B2
(45) Date of Patent: Nov. 17, 2026

(54) SMOKING DEVICE WITH MAIN UNIT HAVING A REMOVABLE COVER ELEMENT

(71) Applicant: Philip Morris Products S.A., Neuchatel (CH)

(72) Inventor: Jueun Choi, Berkeley, CA (US)

(73) Assignee: Philip Morris Products S.A., Neuchatel (CH)

( * ) Notice: Subject to any disclaimer, the term of this patent is extended or adjusted under 35 U.S.C. 154(b) by 642 days.

(21) Appl. No.: 17/768,788

(22) PCT Filed: Oct. 16, 2020

(86) PCT No.: PCT/EP2020/079270

§ 371 (c)(1),
(2) Date: Apr. 13, 2022

(87) PCT Pub. No.: WO2021/074420

PCT Pub. Date: Apr. 22, 2021

(65) Prior Publication Data

US 2023/0120059 A1 Apr. 20, 2023

(30) Foreign Application Priority Data

Oct. 17, 2019 (EP) ..... 19203811

(51) Int. Cl.
*A24F 15/01* (2020.01)
*A24F 40/95* (2020.01)

(52) U.S. Cl.
CPC ..... *A24F 15/01* (2020.01); *A24F 40/95* (2020.01)

(58) Field of Classification Search
CPC ..... A24F 15/12; A24F 40/95; A24F 23/00; A24F 13/14; A24F 9/16; A24F 15/01
See application file for complete search history.

(56) References Cited

U.S. PATENT DOCUMENTS 2,309,799 A * 2/1943 Tanzi ..... A24F 15/12 206/265
2015/0295615 A1 10/2015 Smith et al.
(Continued)

FOREIGN PATENT DOCUMENTS

CN 201533639 U 7/2010
CN 204967875 U 1/2016
(Continued)

OTHER PUBLICATIONS

Combined Russian Office Action and Search Report issued Feb. 2, 2024 in Russian Patent Application No. 2022112862 (with English translation), 22 pages.
(Continued)

*Primary Examiner* — Michael H. Wilson
*Assistant Examiner* — Stephanie Lynn Moore
(74) *Attorney, Agent, or Firm* — Oblon, McClelland, Maier & Neustadt, L.L.P.

(57) ABSTRACT

A holder for an elongate aerosol-generating device defining a longitudinal axis is provided, including: a cover and defining a docking space to accommodate the device, the cover being moveable between a covering position, in which the cover covers at least a portion of the docking space, and a non-covering position, and when the cover is in the covering position, a first portion of the cover defines a first curve, and when the cover is in the non-covering position, the first portion of the cover defines a second curve, a radius of curvature of the second curve being greater than a radius of curvature of the first curve, and when the device is accommodated in the docking space and the cover is in the covering position, the device is enclosed by the holder so as to be completely surrounded by the holder and the first curve curves around the longitudinal axis.

16 Claims, 6 Drawing Sheets

(56) References Cited

U.S. PATENT DOCUMENTS

| | | | | |
|---|---|---|---|---|
| 2015/0366268 | A1 | 12/2015 | Shabat | |
| 2016/0050975 | A1 | 2/2016 | Worm et al. | |
| 2016/0101909 | A1* | 4/2016 | Schennum | A24F 15/01 206/268 |
| 2016/0336988 | A1 | 11/2016 | Smith et al. | |
| 2017/0005689 | A1 | 1/2017 | Smith et al. | |
| 2017/0208862 | A1 | 7/2017 | Li et al. | |
| 2017/0349338 | A1* | 12/2017 | Ziering | A24F 15/10 |

FOREIGN PATENT DOCUMENTS

| | | | |
|---|---|---|---|
| CN | 207434197 | U | 6/2018 |
| CN | 207855030 | U | 9/2018 |
| CN | 208837105 | U | 5/2019 |
| JP | 40-18388 | | 6/1965 |
| JP | 2003-110679 | A | 4/2003 |
| JP | 3142065 | U | 6/2008 |
| JP | 2018-38580 | A | 3/2018 |
| JP | D1637738 | | 7/2019 |
| JP | 2019-167022 | A | 10/2019 |
| KR | 20-2013-0003738 | U | 6/2013 |
| KR | 10-1523477 | B1 | 5/2015 |
| RU | 132 318 | U1 | 9/2013 |
| WO | WO 2018/202730 | A1 | 11/2018 |
| WO | WO 2018/217030 | A1 | 11/2018 |
| WO | WO 2019/037880 | A1 | 2/2019 |
| WO | WO 2019/037881 | A1 | 2/2019 |
| WO | WO 2019/037882 | A1 | 2/2019 |
| WO | WO 2019/037883 | A1 | 2/2019 |

OTHER PUBLICATIONS

International Search report and Written Opinion issued Jan. 12, 2021 in PCT/EP2020/079270, filed on Oct. 16, 2020, 10 pages.

Extended European Search Report issued Apr. 7, 2020 in European Patent Application No. 19203811.5, 6 pages.

International Preliminary Report on Patentability issued Jan. 24, 2022 in PCT/EP2020/079270, 15 pages.

Written Opinion of the International Preliminary Examining Authority issued Aug. 31, 2021 in PCT/EP2020/079270, 29 pages.

Japanese Office Action issued Sep. 30, 2024 in Japanese Patent Application No. 2022-522288 (with unedited computer-generated English Translation), 13 pages.

Japanese Office Action issued Aug. 4, 2025 in Japanese Patent Application No. 2022-522288 (with unedited computer-generated English Translation), 5 pages.

Combined Chinese Office Action and Search Report issued Mar. 28, 2025, in corresponding Chinese Patent Application No. 202080071558.2 with English Translation), 18 pages.

Office Action dated Jun. 25, 2026 issued in corresponding European Patent Application No. 20789203.5 (citing document 1).

* cited by examiner

SMOKING DEVICE WITH MAIN UNIT HAVING A REMOVABLE COVER ELEMENT

The invention relates to a holder for an aerosol-generating device. Specifically, the invention relates to a holder for an aerosol-generating device, the holder comprising a cover.

An aerosol-generating system typically comprises an aerosol-generating device and an aerosol-forming substrate. The aerosol-generating device typically comprises an electrical power supply and an atomiser. When power is supplied to the atomiser, the atomiser atomises volatile compounds in the aerosol-forming substrate to form an aerosol.

Some aerosol-generating devices can be scratched or otherwise damaged if not protected from the external environment.

It would be desirable to provide a holder which can protect an aerosol-generating device when the device is not being used, whilst also allowing a user to easily access the aerosol-generating device when desired.

As used herein, the term "aerosol-generating device" refers to a device that interacts with an aerosol-forming substrate to generate an aerosol. An aerosol-generating device may interact with an aerosol-generating article comprising an aerosol-forming substrate, or with a cartridge comprising an aerosol-forming substrate. In some examples, the aerosol-generating device may heat the aerosol-forming substrate to facilitate release of volatile compounds from the substrate. An electrically operated aerosol-generating device may comprise an atomiser, such as an electric heater, to heat the aerosol-forming substrate to form an aerosol.

As used herein, the term "aerosol-forming substrate" refers to a substrate capable of releasing volatile compounds that can form an aerosol. The volatile compounds may be released by heating or combusting the aerosol-forming substrate. As an alternative to heating or combustion, in some cases, volatile compounds may be released by a chemical reaction or by a mechanical stimulus, such as ultrasound. The aerosol-forming substrate may be solid or liquid or may comprise both solid and liquid components.

As used herein, the term "aerosol-generating article" refers to an article comprising an aerosol-forming substrate. In some examples, the aerosol-generating article may comprise an aerosol-forming substrate capable of releasing volatile compounds upon heating, and these volatile compounds may form an aerosol.

As used herein, the term "aerosol" refers to a dispersion of solid particles or liquid droplets or a combination of solid particles and liquid droplets in a gas. The aerosol may be visible or invisible. The aerosol may include vapours of substances that are ordinarily liquid or solid at room temperature as well as solid particles or liquid droplets or a combination of solid particles and liquid droplets.

As used herein, with reference to an aerosol-generating device (or article), the term "longitudinal" is used to describe a direction between a downstream, proximal or mouth end of the device (or article) and an opposed, upstream or distal end of the device (or article).

As used herein, with reference to an aerosol-generating device or article, the term "transverse" is used to describe a direction perpendicular to the longitudinal direction.

As used herein, with reference to an aerosol-generating device (or article), the term "length" is used to describe a maximum longitudinal dimension between the distal or upstream end of the device (or article) and the proximal or downstream end of the device (or article).

As used herein, the term "diameter" is used to describe the maximum transverse dimension of components, for example aerosol-generating devices and aerosol-generating articles.

As used herein, the term "exposed" is used to indicate that a portion of a feature or component is open to the external environment and not enclosed or covered.

According to the present disclosure, there is provided a holder for an aerosol-generating device. The holder may comprise a cover. The holder may define a docking space for accommodating the aerosol-generating device. The cover may be moveable between a covering position, in which the cover covers at least a portion of the docking space, and a non-covering position. When the cover is in the covering position, a first portion of the cover may define a first curve. When the cover is in the non-covering position, the first portion of the cover may define a second curve. A radius of curvature of the second curve may be greater than a radius of curvature of the first curve.

According to one example, there is provided a holder for an aerosol-generating device. The holder comprises a cover and defines a docking space for accommodating the aerosol-generating device. The cover is moveable between a covering position, in which the cover covers at least a portion of the docking space, and a non-covering position. When the cover is in the covering position, a first portion of the cover defines a first curve. When the cover is in the non-covering position, the first portion of the cover defines a second curve. A radius of curvature of the second curve is greater than a radius of curvature of the first curve.

Advantageously, according to this example, when the cover is in the covering position, the cover covers at least a portion of the docking space. When the cover is in the covering position, substantially the whole docking space may be covered, for example, the entire docking space may be covered. Thus, when the cover is in the covering position, the cover may protect an aerosol-generating device which is accommodated in the docking space.

When the cover is in the non-covering position, at least a portion of an aerosol-generating device accommodated in the docking space may be exposed. The non-covering position may be any position in which the docking space is covered to a lesser degree than in the covering position. There may be a plurality of positions that the cover can be arranged in that can be designated non-covering positions. When the cover is in the non-covering position, a user may be able to access an aerosol-generating device accommodated in the docking space. The cover may be moveable between the covering position and the non-covering position by a user.

Advantageously, a user may therefore be able move the cover to the covering position to protect an aerosol-generating device accommodated in the docking space, for example during transit, and can move the cover to the non-covering position when access to the device is desired.

The holder may comprise a first wall. The holder may comprise a second wall. The second wall may oppose the first wall. The docking space may be defined between the first wall and the second wall. The first wall and the second wall may be substantially parallel to each other. The first wall may be spaced from, and fixed relative to, the second wall. The docking space may be configured to accommodate a longitudinal dimension of an aerosol-generating device, such as an elongate aerosol-generating device, between the first wall and the second wall.

The docking space may be further defined by a rear wall extending between the first wall and the second wall. The docking space may be at least partially defined by the first wall, the second wall, and the rear wall.

The holder may be configured to engage with an aerosol-generating device accommodated in the docking space. The holder may be configured to engage with an aerosol-generating device accommodated in the docking space so as to retain the device in the docking space. A coupling member of the holder may be configured to engage with a corresponding coupling member of the aerosol-generating device when the device is accommodated in the docking space.

The holder may comprise a power supply, for example a rechargeable power supply. The power supply of the holder may be configured to supply power to an aerosol-generating device accommodated in the docking space.

The coupling member may comprise an electrical contact and the corresponding coupling member may comprise a corresponding electrical contact. When an aerosol-generating device is accommodated in the docking space, the electrical contact and the corresponding electrical contact may form an electrical connection. This electrical connection may allow the power supply of the holder to supply power to the device accommodated in the docking space.

The holder may comprise a housing. The housing may comprise the first wall. The housing may comprise the second wall. The housing may comprise the rear wall.

The aerosol-generating device may be an elongate aerosol-generating device. The aerosol-generating device may have a first, longitudinal dimension that is greater than a second, width dimension and a third, thickness dimension. The second and third dimensions may be substantially the same and therefore both be referred to as width. The aerosol-generating device may be substantially cylindrical. The aerosol-generating device may be shaped substantially like a cigarette or cigar.

The longitudinal dimension may define a longitudinal axis. The width dimensions may extend perpendicularly to the longitudinal axis.

The aerosol-generating device may be described as having a proximal end and a distal end. The device may comprise an elongate body extending between the proximal end and the distal end. The body may comprise at least one side surface extending between the proximal end and the distal end.

Accommodating the aerosol-generating device in the docking space may be effected by relative movement of the aerosol-generating device and the docking space in a direction substantially perpendicular to the longitudinal dimension of the aerosol-generating device.

For example, either a proximal end or a distal end of the aerosol-generating device may be inserted in the docking space. The opposite end may then be pivoted into the docking space such that the aerosol-generating device is fully accommodated in the docking space.

Advantageously, by using substantially perpendicular movement, less distance needs to be travelled to accommodate the aerosol-generating device in the docking space than in a holder that accommodates the aerosol-generating device when the device is inserted in a longitudinal direction into a docking space.

The docking space may accommodate the longitudinal dimension of the aerosol-generating device.

When the aerosol-generating device is accommodated in the docking space and the cover is in the non-covering position, at least a portion of the aerosol-generating device may be exposed.

Advantageously, this may allow a user to easily retrieve the device by gripping the exposed portion of the aerosol-generating device, and removing the device from the holder.

The cover may be moveable to a position in which the cover is substantially planar. This position may be termed a substantially planar position of the cover. In the substantially planar position, the cover may have a length, a height, and a thickness which is less than 10% of the length, or less than 10% of the height, or less than 10% of the length and less than 10% of the height. In the substantially planar position, the cover may have a cuboid or cuboid-like shape.

For example, in the substantially planar position, the thickness may be less than 5% of the length, or less than 5% of the height, or less than 5% of the length and less than 5% of the height.

In the substantially planar position, the thickness may be between around 0.5 mm and around 4.5 mm. For example, the thickness may be between 1 mm and 3 mm, for example between 1.25 mm and 2 mm. In the substantially planar position, the height may be between around 50 mm and around 200 mm. For example, the height may be between 75 mm and 150 mm. In the substantially planar position, the length may be between around 40 mm and around 180 mm. For example, the length may be between 50 mm and 150 mm.

The cover may resist curving around an axis extending in the direction of the height of the cover less than curving around an axis extending in the direction of the length of the cover. That is, the cover may preferentially curve around an axis extending in the direction of the height of the cover. The cover may preferentially curve around an axis substantially parallel to a longitudinal axis of an aerosol-generating device located within the docking space.

The cover may resist curving around an axis extending in the direction of the height of the cover less than curving around an axis extending in the direction of the thickness of the cover.

The cover may be more flexible in a first direction than in a second direction. Advantageously, this may give the cover some rigidity whilst allowing a user to easily curve the cover around an axis extending in the direction of the height of the cover, for example an axis substantially parallel to a longitudinal axis of the docking space or an axis substantially parallel to a longitudinal axis of an aerosol-generating device located within the docking space.

In the non-covering position of the cover, all or substantially all of the docking space may be exposed. Alternatively, in the non-covering position of the cover, a portion of the docking space may be exposed.

When an elongate aerosol-generating device defining a longitudinal axis is accommodated in the docking space and the cover is in the covering position, the first curve, defined by the first portion of the cover, may curve around the longitudinal axis of the elongate aerosol-generating device.

When an elongate aerosol-generating device is accommodated in the docking space and the cover is in the non-covering position, at least 80% or 90% or 95% or substantially all of the length of the elongate aerosol-generating device may exposed.

Advantageously, this may allow a user to easily grip the device to remove the device from the docking space. Further, this may allow a user to see an indicator, such as a screen, on a device accommodated in the docking space. The indicator may, for example, allow a user to ascertain whether a device is fully charged without removing the device from the socking space.

The cover may comprise a first attachment portion. The holder may comprise a first side wall having a first attachment portion. The housing of the holder may comprise the first side wall. The first attachment portion may comprise a recess in the first side wall to accommodate a thickness of the cover. The first attachment portion of the cover may be attachable to, and detachable from, the first attachment portion of the first side wall.

The first attachment portion of the cover may be located at or towards a first side of the cover.

An attachment between the first attachment portion of the first side wall and the first attachment portion of the cover may be termed a first attachment. The first attachment may be or comprise a magnetic attachment. The first attachment may be, or comprise, a mechanical attachment, for example made by a mechanical fastening.

The first attachment portion of the cover may be, or may comprise, one or more of a magnet, a magnetic material, a component of a hook-and-loop fastener such as Velcro®, a button, a hook, a recess, and a clip.

The first attachment portion of the first side wall may be, or may comprise, one or more of a magnet, a magnetic material, a component of a hook-and-loop fastener such as Velcro®, a button, a hook, a recess, and a clip.

The first attachment portion of the cover may comprise an elongate magnet or an elongate strip of magnetic material. The elongate magnet or elongate strip of magnetic material may be located at or towards a first side of the cover. The elongate magnet or elongate strip of magnetic material may extend along at least 80% or 90% or 95% of the height of the cover.

The first attachment portion of the first side wall may comprise a corresponding magnet, such as a corresponding elongate magnet, or a corresponding strip of magnetic material, such as a corresponding elongate strip of magnetic material. The term magnetic material relates to a material that interacts with a magnet, for example a ferritic material such as iron or stainless steel that is attracted to a magnet.

When the cover is in the covering position, the corresponding magnet or corresponding magnetic material of the first attachment portion of the first side wall may align with the elongate magnet or the elongate strip of magnetic material of the first attachment portion of the cover. When the cover is in the covering position, the corresponding magnet or corresponding magnetic material of the first attachment portion of the first side wall may contact the elongate magnet or the elongate strip of magnetic material of the first attachment portion of the cover.

Advantageously, this may provide a sturdy but reversible attachment between the first attachment portion of the cover to the first attachment portion of the first side wall.

The first attachment portion of the cover may comprise a protruding element, for example a protruding element comprising a magnet or magnetic material, or a protruding element forming a mechanical fastener. The protruding element may be a polymeric material and may resiliently deform or have a resiliently deformable portion for mechanical engagement with a corresponding slot, recess, or socket. The protruding element may protrude in the direction of the thickness of the cover.

The first side wall may comprise a groove. The protruding element of the cover may be configured to be received in the groove of the first side wall when the cover is in the covering position. The groove may comprise a corresponding magnet or corresponding magnetic element. Thus, when the cover is in the covering position, the protruding element may align with, or contact, the corresponding magnet or corresponding magnetic element of the groove. The groove may be a socket and may mechanically interact with the protruding element to form an attachment between the first attachment point of the cover and the first attachment point of the first side wall.

The first side wall may comprise one or more groove or socket. The each of the one or more groove or socket may engage with a corresponding protruding element extending from a portion of the cover to form the first attachment.

Advantageously, this may provide a sturdy but reversible attachment between the first attachment portion of the cover to the first attachment portion of the first side wall.

The cover may comprise a second attachment portion. The holder may comprise a second side wall having a second attachment portion. The housing of the holder may comprise the second side wall. The second attachment portion may comprise a recess in the second side wall to accommodate a thickness of the cover. The second attachment portion of the cover may be attachable to, and detachable from, the second attachment portion of the second side wall.

The second attachment portion of the cover may be located at or towards a second side of the cover.

An attachment between the second attachment portion of the second side wall and the second attachment portion of the cover may be termed a second attachment. The second attachment may be or comprise a magnetic attachment. The second attachment may be, or comprise, a mechanical attachment, for example made by a mechanical fastening.

The second attachment portion of the cover may be, or may comprise, one or more of a magnet, a magnetic material, a component of a hook-and-loop fastener such as Velcro®, a button, a hook, a recess, and a clip.

The second attachment portion of the second side wall may be, or may comprise, one or more of a magnet, a magnetic material, a component of a hook-and-loop fastener such as Velcro®, a button, a hook, a recess, and a clip.

The second attachment portion of the cover may comprise a stiffener, for example a non-magnetic stiffener. The stiffener may extend along at least 80% or 90% or 95% of the height of the cover.

The second attachment portion of the cover may comprise a magnet or a magnetic element. For example, the second attachment portion of the cover may comprise a plurality of magnets or magnetic elements. The plurality of magnets or magnetic elements may be spaced along the height of the cover. For example, the plurality of magnets or magnetic elements may be evenly spaced along the height of the cover. The plurality of magnets or magnetic elements may be spaced along the stiffener. For example, the plurality of magnets or magnetic elements may be evenly spaced along the stiffener.

The second attachment portion of the wall may comprise one or more corresponding magnets or corresponding magnetic elements. When the cover is in the covering position, the corresponding magnets or corresponding magnetic elements of the second attachment portion of the second side wall may align with the magnets or magnetic elements of the second attachment portion of the cover. When the cover is in the covering position, the corresponding magnets or corresponding magnetic elements of the second attachment portion of the second side wall may contact the magnets or magnetic elements of the second attachment portion of the cover.

The cover may comprise a first attachment point, a second attachment point, or both a first attachment point and a second attachment point, comprising a magnetic attachment member, the magnetic attachment member comprising a magnet or a magnetic material configured to magnetically latch a portion of the cover to a portion of the housing.

The cover may comprise a first attachment point, a second attachment point, or both a first attachment point and a second attachment point, comprising a mechanical attachment member, the mechanical attachment member comprising a deformable protrusion configured to engage with a protrusion receiving slot to mechanically latch a portion of the cover to a portion of the housing, or the mechanical attachment member comprising a protrusion receiving slot configured to engage with a deformable protrusion to mechanically latch a portion of the cover to a portion of the housing. The deformable protrusion may comprise a deformable lip or hook to engage with the protrusion receiving slot.

When the aerosol-generating device is accommodated in the docking space and the cover is in the covering position, the aerosol-generating device may encircled by the holder. For example, the cover and the housing may encircle a device accommodated in the docking space when the cover is in the covering position.

Advantageously, this may protect an aerosol-generating device accommodated in the docking space and may reduce an amount of dust or other debris entering the docking space when the cover is in the covering position.

When the aerosol-generating device is accommodated in the docking space and the cover is in the covering position, the aerosol-generating device may be enclosed by the holder. That is, the device may be completely surrounded by the holder. For example, the cover and the housing may enclose, or completely surround, a device accommodated in the docking space when the cover is in the covering position.

Advantageously, this may protect an aerosol-generating device accommodated in the docking space and may substantially prevent dust or other debris from entering the docking space when the cover is in the covering position.

The cover may comprise a plurality of stiffening elements. Each stiffening element may be formed from, or may comprise, one or more of a plastic or a metal. For example, stiffening elements may be formed from a polymer such as a polycarbonate (PC), or a microfiber plastic, or a composite such as glass fibre composite. Each stiffening element may extend along a height of the cover. For example, each stiffening element may extend along at least 80% or 90% of the height of the cover. The plurality of stiffening elements may be a plurality of elongate stiffening elements. The longest dimension of each elongate stiffening element may extend along the height of the cover, for example along at least 80% or 90% of the height of the cover. The plurality of elongate stiffening elements may be substantially parallel to each other.

The cover may comprise a first layer. The cover may comprise a second layer. The first layer may comprise a textile material, such as a fabric or a felt, or leather, or synthetic leather, or a bioplastic, or a recycled plastic. The second layer may comprise a textile material such as a fabric or a felt, or leather, or synthetic leather, or a bioplastic, or a recycled plastic.

The plurality of stiffening elements may be sandwiched between the first layer and the second layer. The first attachment portion of the cover may be sandwiched between the first layer and the second layer. The second attachment portion of the cover may be sandwiched between the first layer and the second layer.

Each stiffening element may be fixed to the first layer or the second layer, or both the first layer and the second layer.

The plurality of stiffening elements may be substantially evenly spaced from each other.

When an elongate aerosol-generating device is accommodated in the docking space and the cover is in the covering position, the elongate aerosol-generating device and the plurality of elongate stiffening elements may be substantially parallel.

Advantageously, this may allow the cover to provide adequate protection to the device whilst allowing the cover to easily curve around the docking space, or around a device accommodated in the docking space.

The cover may comprise a holding means. The holding means may be configured to hold an accessory. The holding means comprises a strip of elastic material. The strip of elastic material may extend along a height of the cover.

Advantageously, this may allow a user to keep an accessory with the holder. The accessory may be, for example, a pack of aerosol-generating articles for use with the aerosol-generating device.

The strip of elastic material may comprise a first end and a second end, and an intermediate portion extending between the first end and the second end. The first end of the strip of elastic material may be attached, or attachable, to a face of the cover. For example, the first end may comprise a first reversible attachment means, such as a button, a clip, or hook-and-loop fasteners, configured to attach to, and detach from, a first corresponding reversible attachment means on the face of the cover. Alternatively, the first end may be stitched to the face of the cover. The second end of the strip of elastic material may be attached, or attachable, to the face of the cover. For example, the second end may comprise a second reversible attachment means, such as a button, a clip, or hook-and-loop fasteners, configured to attach to, and detach from, a corresponding second reversible attachment means on the face of the cover. Alternatively, the second end may be stitched to the face of the cover. The intermediate portion may not be attached to the face of the cover.

The holding means may be attachable to, and detachable from, the cover. For example, the holding means may comprise the strip of elastic material and the first and the second end may comprise the first reversible attachment means and the second reversible attachment means described above.

Advantageously, this may allow a user to remove the holding means from the cover if it is not desired.

When the strip of elastic material is attached to the cover, a user may be able to pull on the intermediate portion of the strip, such that the strip stretches, to allow an accessory to be inserted between the strip and the face of the cover. When the user releases the intermediate portion of the strip, tension in the strip may act to hold the accessory between the strip and the face of the cover.

According to the present disclosure, there is also provided a system. The system may comprise a holder, for example a holder as described above. That is, the holder of the system may comprise any features described in relation to the holder above. The system may comprise an aerosol-generating device, for example an aerosol-generating device as described above.

That is, the aerosol-generating device of the system may comprise any features described in relation to the aerosol-generating device above.

The invention will now be described, by way of example only, with reference to the accompanying drawings, in which.

Figure 1:
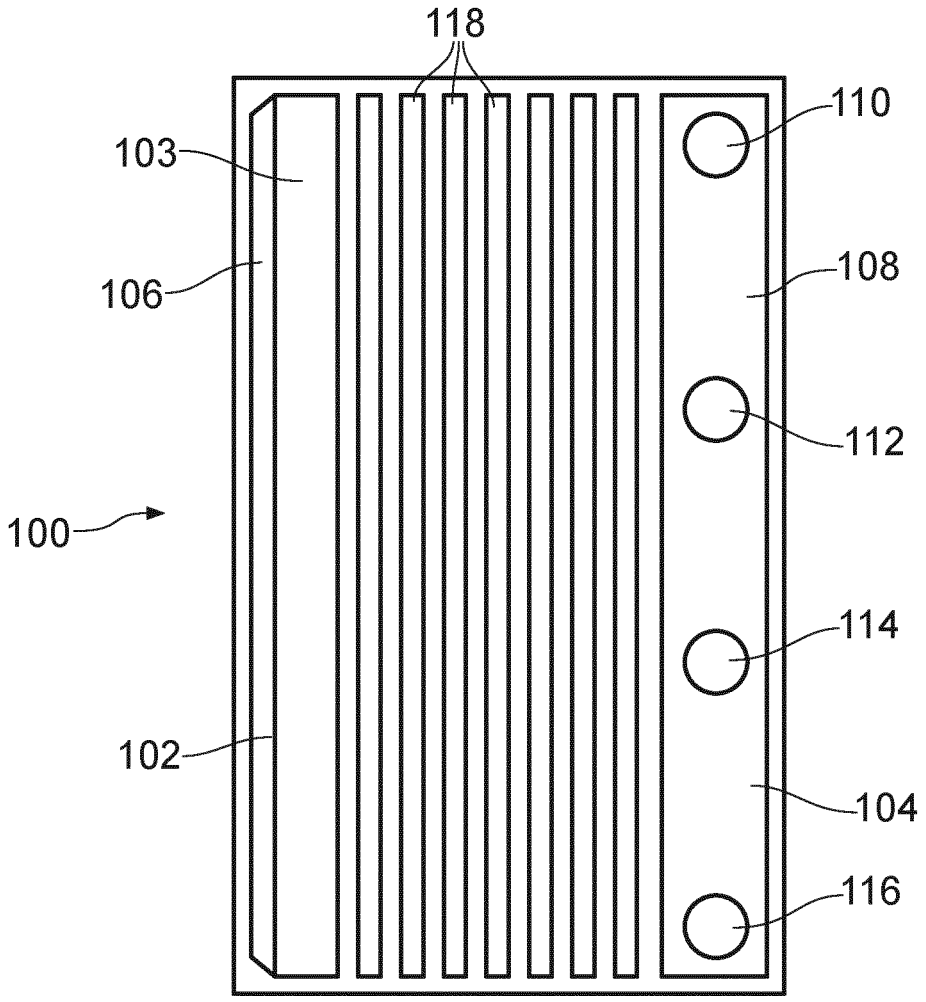
FIG. 1 is a cross-sectional view of a cover.

FIG. 1 is a cross-sectional view of a cover. The cover 100 comprises a first attachment portion 102 located towards a first side of the cover and a second attachment portion 104 located towards a second side of the cover.

The first attachment portion 102 comprises an elongate magnet 103. The elongate magnet 104 extends along substantially the entire height of the cover 100. The first attachment portion 102 also comprises a magnetic protruding element 106. The protruding element protrudes in the direction of the thickness of the cover 100.

The second attachment portion 104 comprises a stiffener 108. The second attachment portion 104 comprises four magnets 110, 112, 114, 116. The four magnets 110, 112, 114, 116 are in contact with, and spaced evenly along, the stiffener 108.

The cover comprises a plurality of stiffening elements 118. The stiffening elements are preferably formed from a suitable polymer material such as polycarbonate (PC). The plurality of stiffening elements 118 are elongate. The longest dimension of each elongate stiffening element extends along substantially the entire height of the cover 100. The plurality of elongate stiffening elements 118 are substantially parallel to each other.

The cover 100 comprises a first layer and a second layer. Since FIG. 1 is a cross-sectional view of the cover 100, the first layer and the second layer cannot be seen in FIG. 1. Both the first layer and the second layer are formed from a textile material. The first attachment portion 102, the second attachment portion 104, and the plurality of stiffening elements 118 are sandwiched between the first layer and the second layer.

Figure 2:
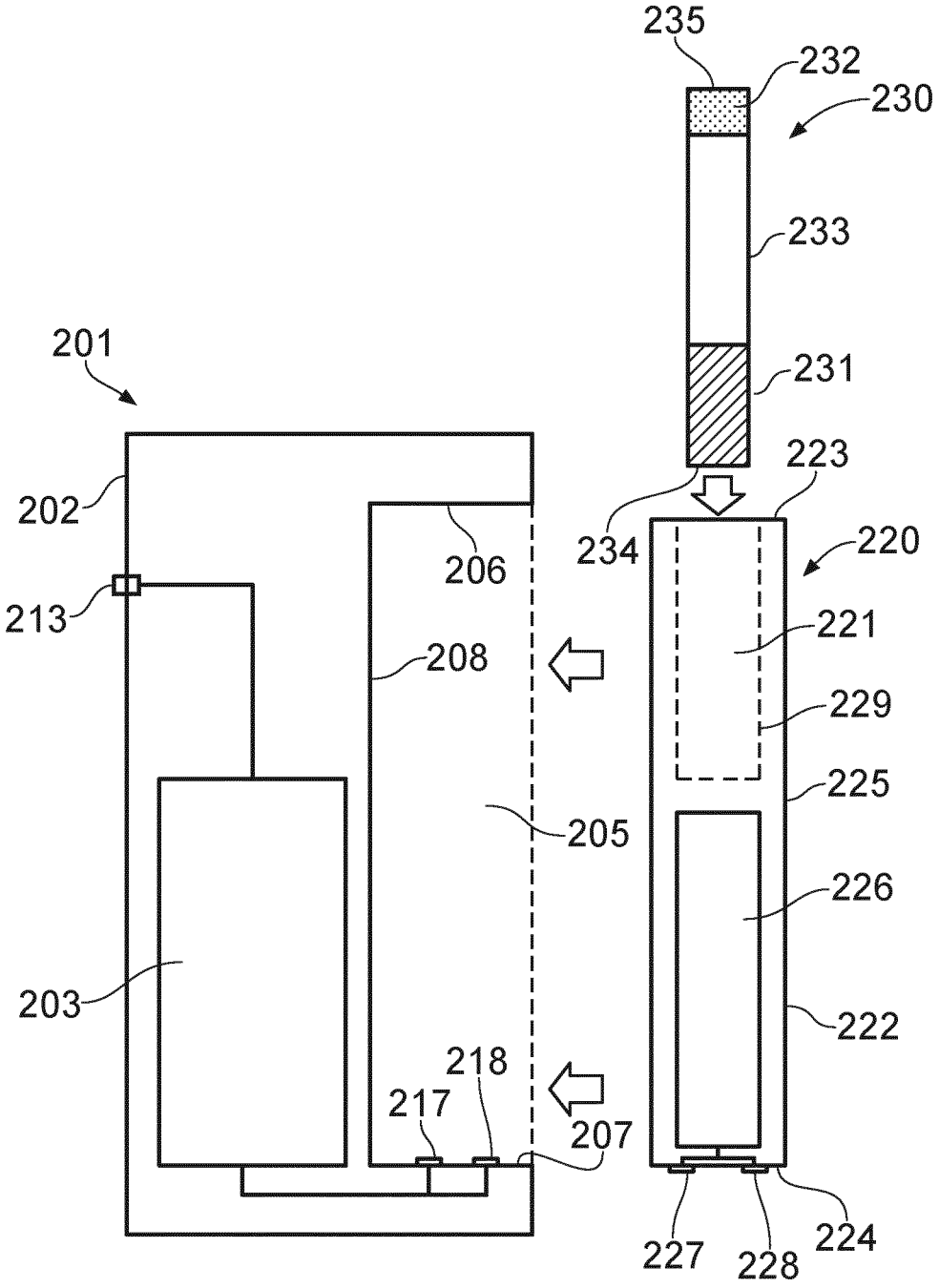
FIG. 2 is a schematic illustration an aerosol-generating device, an aerosol-generating article, and a holder without a cover.

FIG. 2 is a schematic illustration an aerosol-generating device, an aerosol-generating article, and a holder without a cover.

The holder 201 comprises a housing 202 that is approximately the same size and shape as a conventional packet of cigarettes. The housing 202 locates and retains a Li-ion battery 203. This battery 203 may be termed a primary power source or primary battery. The primary battery 203 is electrically connected to a charging port 213 to allow the primary battery 203 to be recharged from an external power supply such as mains power. The holder 201 defines a docking space 205 defined between a first wall 206 and an opposing second wall 207 that is both spaced from and fixed relative to the first wall 206. The docking space is further defined by a rear wall 208. The docking space 205 is elongate and has a longitudinal axis extending between the first wall 206 and the second wall 207. The first wall 206, second wall 207, and rear wall 208 are portions of the housing 202. First and second electrical contacts 217, 218 face into the docking space 205. The first and second electrical contacts are electrically connected to the primary battery 203. The holder further comprises electric circuitry such as at least one microprocessor to control the charging and the discharging of the primary battery 203.

The aerosol-generating device 220 has an elongate housing 222 that is substantially cylindrical having a proximal end 223, a distal end 224, and a body 225 extending between the proximal end 223 and the distal end 224. The length of the device 220 is slightly less than the length of the longitudinal dimension of the docking space 205. First and second device contacts 227, 228 are located by the distal end 224 and face away from the distal end. The first and second device contacts are electrically connected to a device battery 226 to allow for recharging of the device battery 226. The device battery 226, which may be termed a secondary power source or secondary battery, may be any suitable battery, for example a Li-ion battery or a lithium iron phosphate battery.

A substrate-receiving cavity 221 is defined in a proximal portion of the device 220 for receiving an aerosol-generating article comprising an aerosol-forming substrate. The cavity 221 is substantially cylindrical and has an opening defined in the proximal end of the device. Heating elements positioned around internal walls 229 of the substrate-receiving cavity 221 are electrically connected to the device battery 226 and act to heat the cavity. In alternate embodiments, heating elements may be defined on a heating member such as a pin or a blade that is located within the cavity for insertion into an aerosol-generating article. In other embodiments, induction coils may be located around the walls 229 of the cavity 221 to inductively heat a susceptor within the cavity 221 or within an aerosol-generating article inserted into the cavity.

Electronics, including a microprocessor, are included in the aerosol-generating device for controlling charging of the device battery 226 and operation of the heating means.

The aerosol-generating article 230 is a cylindrical article comprising a plurality of components, including an aerosol-forming substrate 231 and a mouthpiece filter 232, assembled within a cigarette paper 233. The article 230 has a distal end 234 and a proximal end 235 or mouth end located downstream of the distal end 234. The aerosol-forming substrate 231 is preferably in the form of a gathered sheet of homogenised tobacco material and is located at or near to the distal end 234 of the article 230. Further components such as aerosol-cooling elements, flavouring elements and spacing elements may be positioned between the aerosol-forming substrate 231 and the mouthpiece filter 232 within the article 230.

The aerosol-generating device 220 may be accommodated in the docking space of the holder 210 by aligning the longitudinal axis of the aerosol-generating device 220 with the longitudinal axis of the docking space 205 (with the proximal end 223 of the aerosol-generating device 220 adjacent the first wall 206 and the distal end 224 of the aerosol-generating device 220 adjacent the second wall 207). The aerosol-generating device may then be moved into engagement by a translational movement, that is a movement perpendicular to the longitudinal axis of the aerosol-generating device 220, into the docking space 205. The proximal end 223 of the aerosol-generating device 220 engages with the first wall 206 and the distal end of the aerosol-generating device 224 engages with the second wall 207. The first and second contacts 217, 218 align with, and make electrical contact with, the first and second device contacts 227, 228. The aerosol-generating device may be held in engagement by an interference, or frictional, engagement. Alternatively, mechanical latching means may be automatically or manually operated to retain the aerosol-generating device in engagement with the holder. In other embodiments, magnetic latching means may be used to retain the aerosol-generating device in engagement with the holder.

Charging of the device battery may be effected automatically on engagement between the aerosol-generating device 220 and the holder 201. Alternatively, charging may require manual actuation, for example by operating a button.

The aerosol-generating device 220 may be removed from engagement with the holder 201 by gripping an exposed portion of the aerosol-generating device and moving the aerosol-generating device out of the docking space with a transverse movement.

Once the device battery 226 has been charged, the aerosol-generating device may be used for consumption of a consumable aerosol-generating article. The aerosol-generating device is removed from docking space 205 and the aerosol-generating article is inserted into the substrate-receiving cavity 221. The heater of the device 220 is then actuated and the aerosol-forming substrate 231 of the article 230 is heated to a temperature sufficient to generating an inhalable aerosol. By drawing on the proximal end 235 of the article 230, a user is able to inhale the aerosol into their mouth and lungs. Once the article has been consumed, it can be removed from the device 220, and the aerosol-generating device 220 can be accommodated in the docking space 205 of the holder 201 for protection or for recharging of the device battery 226.

In some embodiments, data may be transferred between the aerosol-generating device and the holder. The data may be transferred using the same contacts that are used for charging 217, 218, 227, 228. Alternatively, separate data contacts may be provided. Data transfer between the holder 201 and the aerosol-generating device 220 may be achieved wirelessly, for example by Bluetooth connection.

In one example, the first and second charging contacts 217, 218 may be in the form of concentric rings. The device charging contacts 227, 228 may be corresponding concentric rings, or may be point contacts configured to align with the respective concentric rings. The advantage of this configuration is that the aerosol-generating device may be engaged with the holder in any radial orientation, and the holder may still be able to charge the device.

Figure 3:
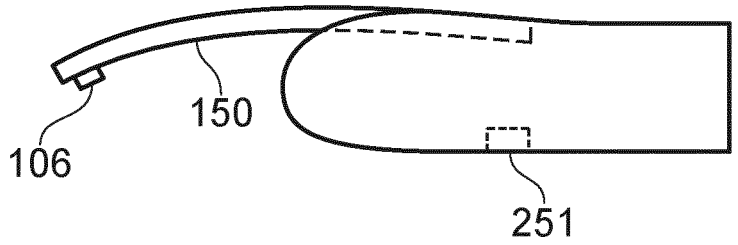
FIG. 3 is a schematic top view of the holder shown in FIG. 2 with the cover shown in FIG. 1 in a non-covering position.

FIG. 3 is a schematic top view of the holder shown in FIG. 2 with the cover shown in FIG. 1 in a non-covering position.

Figure 4:
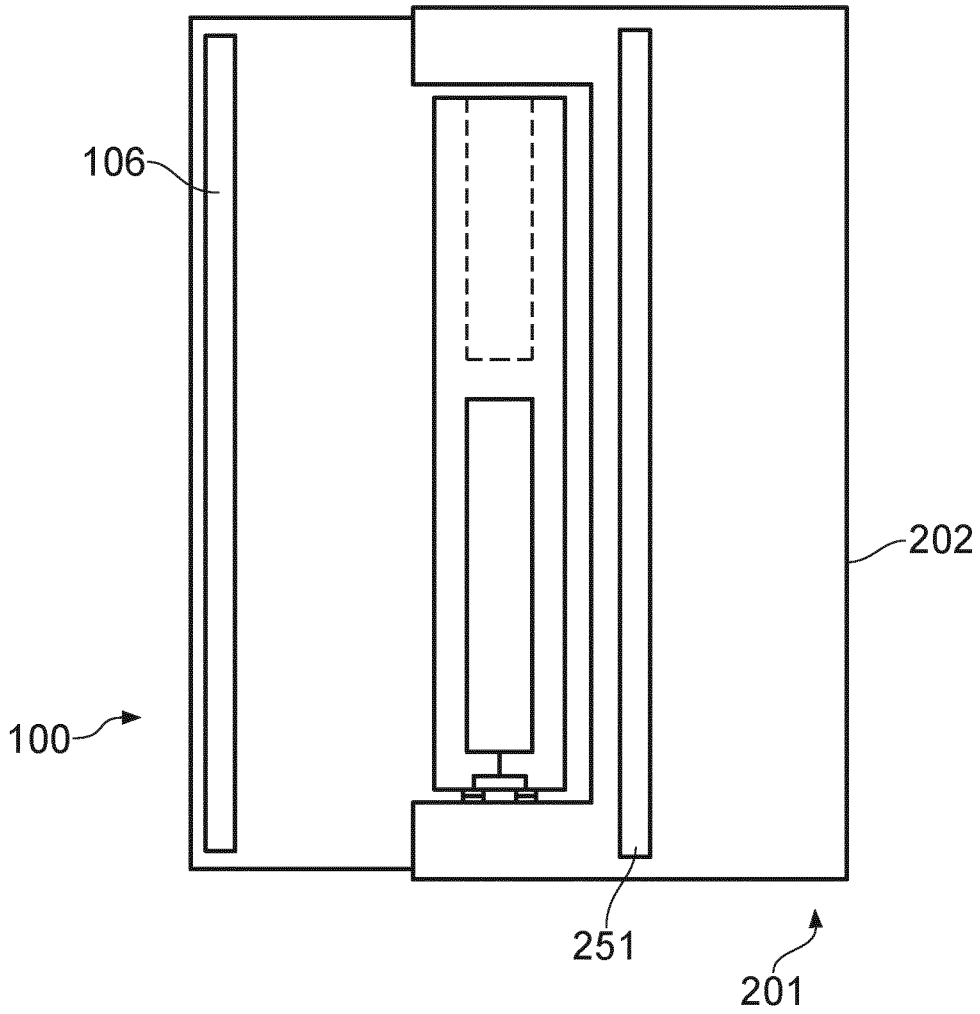
FIG. 4 is a schematic side view of the holder shown in FIG. 2 with the cover shown in FIG. 1 in a non-covering position.

FIG. 4 is a schematic side view of the holder shown in FIG. 2 with the cover shown in FIG. 1 in a non-covering position.

Compared with FIG. 2, FIG. 4 show the holder 201 after being rotated by 180 degrees. Thus, FIG. 4 shows an opposite side of the holder 201 to that shown in FIG. 2.

In FIG. 4, the cover is in a non-covering position. In the non-covering position shown in FIG. 4, the magnets 110, 112, 114, 116 of the second attachment portion 104 of the cover 100 are in contact with a second side wall of the housing 202, and the second side wall comprises a magnetic material. Thus, the magnetic attraction between the magnets 110, 112, 114, 116 and the magnetic material attaches the second attachment portion 104 to the second side wall of the housing 202.

As can be seen in FIG. 4, a first side wall of the housing 202 comprises a first attachment portion having a groove 251. The magnetic protruding element 106 of the cover 100 is configured to be received in the groove 251 when the cover 100 is in the covering position. The groove 251 comprises a corresponding magnetic element.

Figure 5:
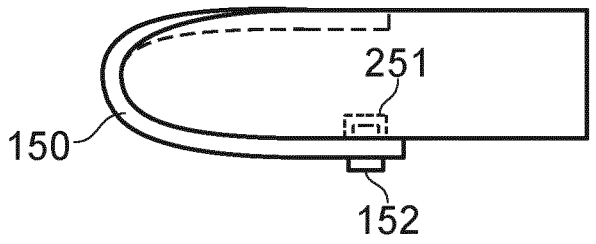
FIG. 5 is a schematic top view of the holder shown in FIG. 2 with the cover shown in FIG. 1 in a covering position.

FIG. 5 is a schematic top view of the holder shown in FIG. 2 with the cover shown in FIG. 1 in a covering position.

Figure 6:
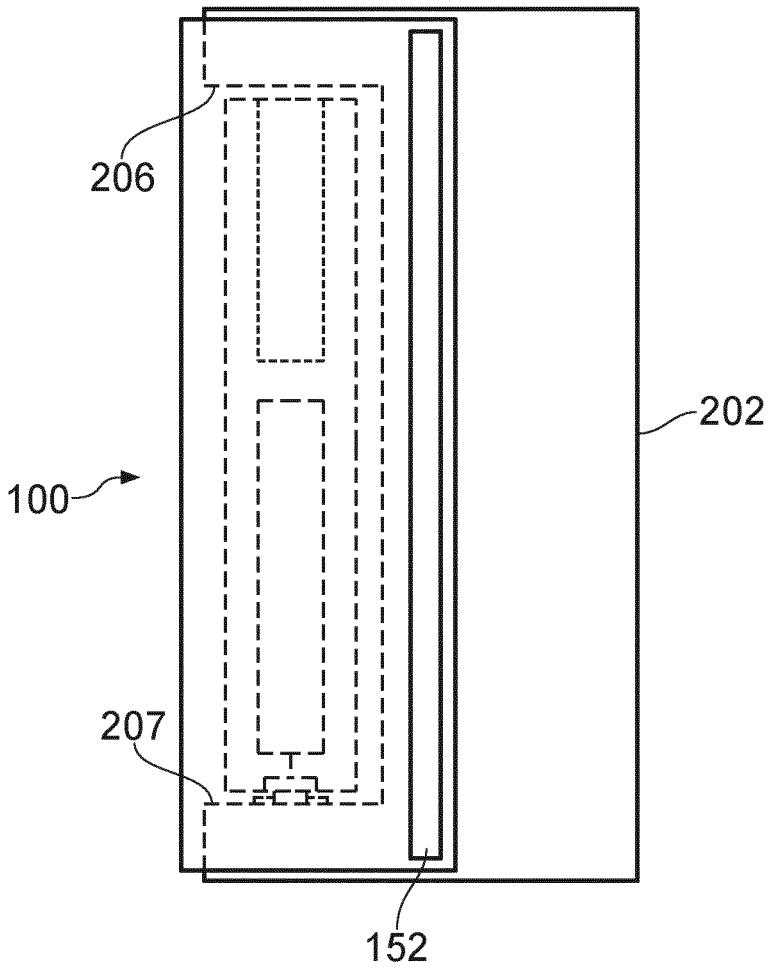
FIG. 6 is a schematic side view of the holder shown in FIG. 2 with the cover shown in FIG. 1 in a covering position.

FIG. 6 is a schematic side view of the holder shown in FIG. 2 with the cover shown in FIG. 1 in a covering position.

When the cover is in the covering position shown in FIG. 6, a first portion 150 of the cover 100 defines a first curve having a radius of curvature. When the cover is in the non-covering position shown in FIG. 4, the first portion 150 of the cover 100 defines a second curve having a radius of curvature. As can be seen from FIGS. 4 and 6, the radius of curvature of the second curve is greater than the radius of curvature of the first curve.

To move the cover from the position shown in FIG. 4 to the position shown in FIG. 6, a user has simply curved the cover 100 around an outer portion of the first wall 206 and an outer portion of the second wall 207. The magnetic protruding element 106 has then been received in the groove 251.

As shown in FIG. 6, when the cover is in the covering position, the magnetic protruding element 106 contacts the corresponding magnetic element of the groove 251. Thus, magnetic attraction between the magnetic protruding element 106 and the corresponding magnetic element of the groove 251 attaches the first attachment portion 102 of the cover 100 to the first attachment portion of the first side wall of the housing 202.

In the example shown in FIG. 6, when the cover 100 is in the covering position and the aerosol-generating device 220 is accommodated in the docking space 205, the device is enclosed by the housing 202 and the cover 100. As such, the device 220 is enclosed by the holder 201, and is protected from the external environment.

In the example shown in FIG. 6, the cover 100 comprises a holding means 152 configured to hold an accessory. The holding means 152 comprises a strip of elastic material. The strip of elastic material extends along a height of the cover 100. The strip of elastic material comprises a first end and a second end, and an intermediate portion extending between the first end and the second end. The first end and the second end of the strip of elastic material are attached to a face of the cover. In this example, the first end and the second end are stitched to the textile material of the first layer of the cover 100. The intermediate portion is not attached to the face of the cover.

Figure 7:
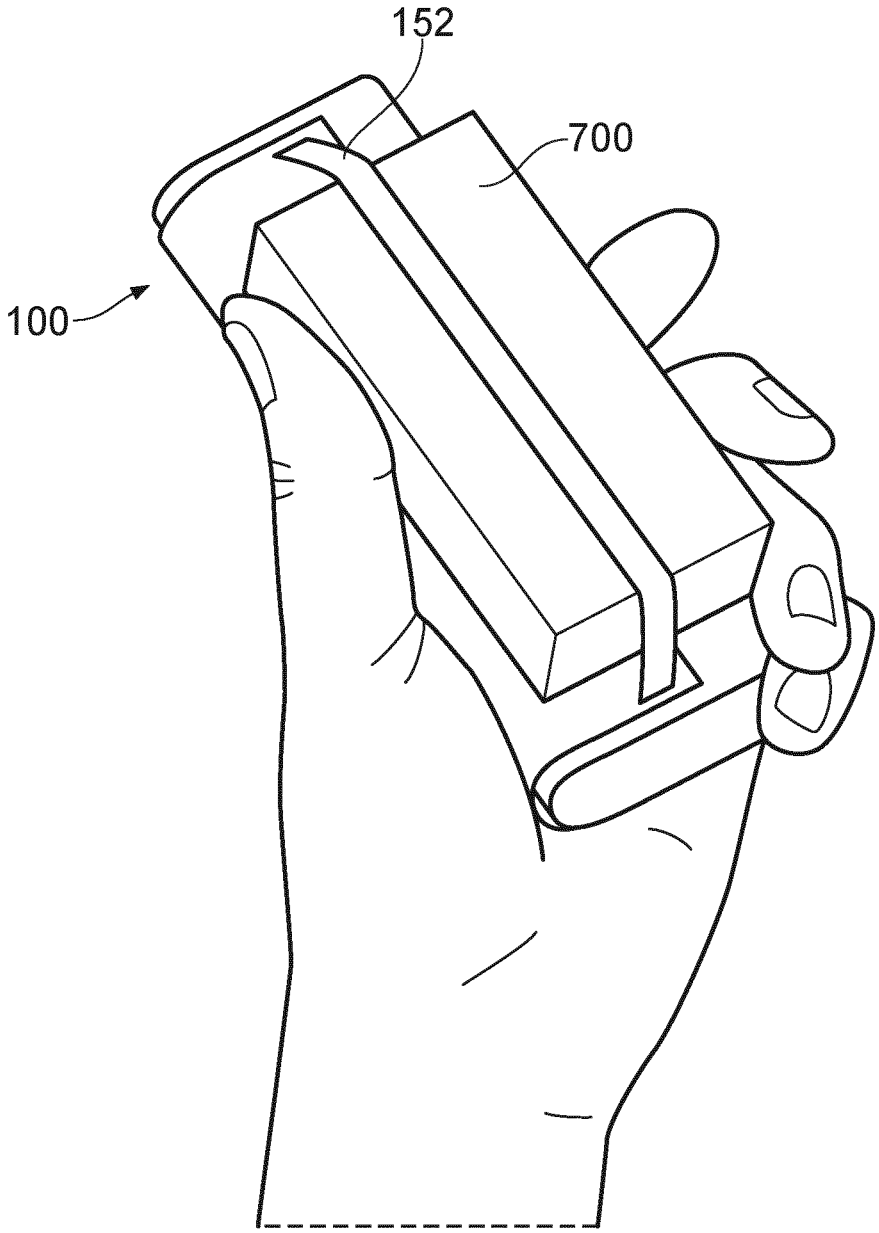
FIG. 7 is a schematic illustration of the holder shown in FIG. 4 with the cover in the covering position, in which a holding means of the cover is holding an accessory.

FIG. 7 is a schematic illustration of the holder shown in FIG. 6 with the cover in the covering position, in which a holding means of the cover is holding an accessory.

For the holding means 152 to hold the accessory 700, a user has pulled on the intermediate portion of the strip, such that the strip stretches to form a space between the intermediate portion of the strip and the face of the cover. The accessory may be, for example, a container of consumable, such as a packet of heated aerosol-generating articles. Then, the user has inserted the accessory 700 into this space between the strip and the face of the cover 100. The user has then released the intermediate portion of the strip. After the user releases the intermediate portion of the strip, tension in the strip acts to hold the accessory 700 between the strip and the face of the cover 100.

Figure 8:
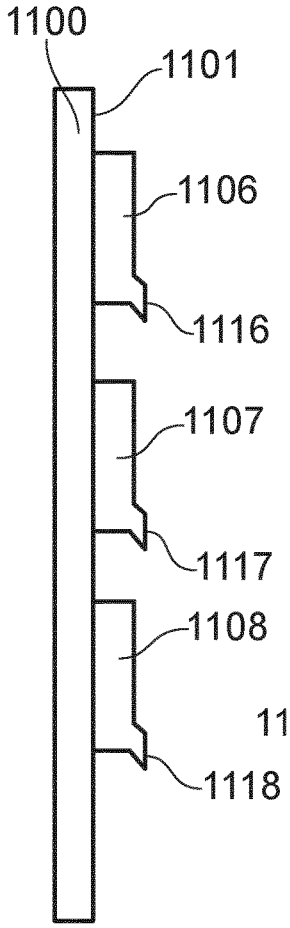
FIG. 8 is a schematic end view of a cover according to a further specific embodiment, showing protruding elements.

The specific embodiment described above uses magnetic latching means to retain the cover in the covering position. In other embodiments other latching means may be used, for example mechanical latching means or a combination of mechanical latching means and magnetic latching means. FIG. 8 is a schematic end view illustration of a cover 1100 that employs a mechanical latching means.

The cover 1100 is shown in an end view such that the thickness and height of the cover 1100 can be seen. Three resilient protruding elements 1106, 1107, 1108 are defined extending from a first side 1101 of the cover 1100. The protruding elements are formed from a resilient material such as a polymeric material, for example a silicone material. Each of the three elements 1106, 1107, 1108 defines a lip 1116, 1117, 1118 that is easily and resiliently deformable.

Figure 9:
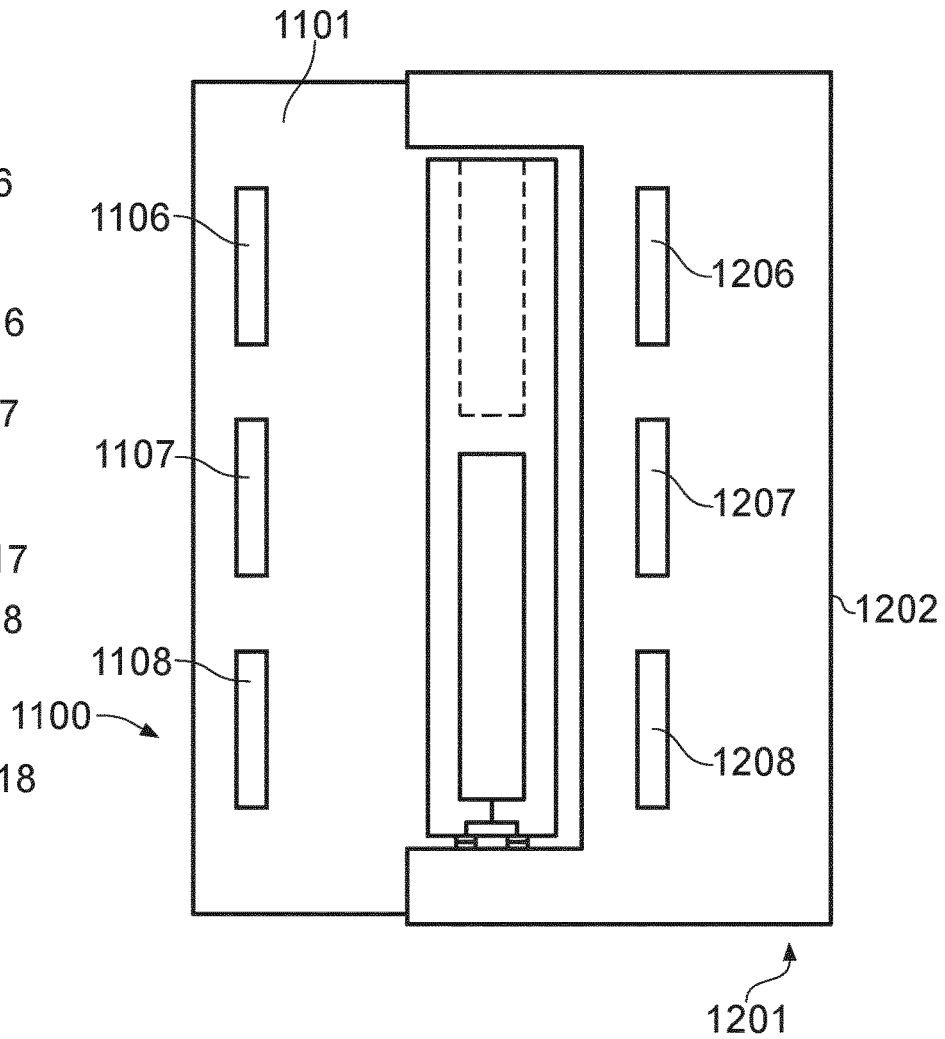
FIG. 9 is a schematic side view of a further specific embodiment of a holder, incorporating the cover as illustrated in FIG. 8.

A holder 1201 that interacts with the cover 1100 is illustrated in FIG. 9. Features of FIG. 9 are the same as those described in relation to the holder of FIG. 4, except for the following. A first side wall of the housing 1202 comprises a first attachment portion defining three slots or sockets 1206, 1207, 1208. Each of the three slots or sockets 1206, 1207, 1208 aligns with a corresponding protruding element 1106, 1107, 1108 when the cover 1101 is moved to the covering position. Pressure applied to the cover presses each of the protruding elements 1106, 1107, 1108 into its corresponding slot or socket 1206, 1207, 1208. The lip 1116, 1117, 1118 of each protruding element deforms on entering its slot or socket and recovers shape within its slot or socket to mechanically retain the cover in the covering position.

The invention claimed is:

1. A holder for an elongate aerosol-generating device defining a longitudinal axis, the holder comprising:

a cover and defining a docking space configured to accommodate the aerosol-generating device, wherein the cover is moveable between a covering position, in which the cover covers at least a portion of the docking space, and a non-covering position, wherein, when the cover is in the covering position, a first portion of the cover defines a first curve, and when the cover is in the non-covering position, the first portion of the cover defines a second curve, a radius of curvature of the second curve being greater than a radius of curvature of the first curve, wherein, when the elongate aerosol-generating device is accommodated in the docking space and the cover is in the covering position, the elongate aerosol-generating device is enclosed by the holder so as to be completely surrounded by the holder and the first curve curves around the longitudinal axis of the elongate aerosol-generating device, wherein the holder comprises a first wall and a second wall opposing the first wall, wherein the docking space is defined between the first wall and the second wall, wherein the first wall is spaced from, and fixed relative to, the second wall, wherein the docking space is configured to accommodate a longitudinal dimension of the elongate aerosol-generating device between the first wall and the second wall, wherein the cover comprises a first cover attachment portion and a second cover attachment portion, and the holder comprises a first side wall having a first side wall attachment portion and a second side wall having a second side wall attachment portion, wherein the first cover attachment portion of the cover is attachable to, and detachable from, the first side wall attachment portion of the first side wall, attachment between the first cover attachment portion of the cover and the first side wall attachment portion of the first side wall being or comprising a first magnetic attachment, and wherein the second cover attachment portion of the cover is attachable to, and detachable from, the second side wall attachment portion of the second side wall, attachment between the second cover attachment portion of the cover and the second side wall attachment portion of the second side wall being or comprising a second magnetic attachment.

2. The holder according to claim 1, wherein the cover is moveable to a position in which the cover is substantially planar and has a length, a height, and a thickness, and wherein the thickness is less than 10% of the length, or less than 10% of the height, or less than 10% of the length and less than 10% of the height.

3. The holder according to claim 1, wherein the elongate aerosol-generating device has a length, and when the elongate aerosol-generating device is accommodated in the docking space and the cover is in the non-covering position, at least 80% of the length of the elongate aerosol-generating device is exposed.

4. The holder according to claim 1, wherein the cover further comprises a first attachment point, a second attachment point, or both a first attachment point and a second attachment point, comprising a magnetic attachment member, the magnetic attachment member comprising a magnet or a magnetic material configured to magnetically latch a portion of the cover to a portion of a housing of the holder.

5. The holder according to claim 1, wherein the cover further comprises a first attachment point, a second attachment point, or both a first attachment point and a second attachment point, comprising a mechanical attachment member, the mechanical attachment member comprising a deformable protrusion configured to engage with a protrusion receiving slot to mechanically latch a portion of the cover to a portion of a housing of the holder, or the mechanical attachment member comprising a protrusion receiving slot configured to engage with a deformable protrusion to mechanically latch a portion of the cover to a portion of the housing.

6. The holder according to claim 1, wherein the cover comprises a plurality of stiffening elements.

7. The holder according to claim 6, wherein the cover further comprises a first layer and a second layer, and the plurality of stiffening elements are sandwiched between the first layer and the second layer.

8. The holder according to claim 7, wherein the first layer or the second layer or both the first layer and the second layer comprise a textile material.

9. The holder according to claim 6, wherein the plurality of stiffening elements are a plurality of elongate stiffening elements.

10. The holder according to claim 9, wherein the plurality of elongate stiffening elements are substantially parallel to each other.

11. The holder according to claim 6, wherein each stiffening element extends along at least 80% of a height of the cover.

12. The holder according to claim 1, wherein the docking space is further defined by a rear wall extending between the first wall and the second wall.

13. The holder according to claim 1, further comprising a power supply configured to supply power to the elongate aerosol-generating device when the elongate aerosol-generating device is accommodated in the docking space.

14. The holder according to claim 1, wherein the elongate aerosol-generating device is configured to be accommodated in the docking space by relative movement of the elongate aerosol-generating device and the docking space, by a user, in a direction substantially perpendicular to the longitudinal axis of the elongate aerosol-generating device.

15. The holder according to claim 1, wherein the cover comprises a holding means for holding an accessory.

16. The holder according to claim 15, wherein the holding means comprises a strip of elastic material.

* * * * *